US011643861B2

(12) United States Patent
Williams et al.

(10) Patent No.: US 11,643,861 B2
(45) Date of Patent: May 9, 2023

(54) RELEASE MECHANISM FOR A DOOR OPERATOR

(71) Applicant: GMI Holdings, Inc., Mt. Hope, OH (US)

(72) Inventors: Gregory E. Williams, Minerva, OH (US); Walter Dennis Reber, Alliance, OH (US)

(73) Assignee: GMI HOLDINGS, INC., Mount Hope, OH (US)

( * ) Notice: Subject to any disclaimer, the term of this patent is extended or adjusted under 35 U.S.C. 154(b) by 116 days.

(21) Appl. No.: 17/181,895

(22) Filed: Feb. 22, 2021

(65) Prior Publication Data

US 2022/0259912 A1 Aug. 18, 2022

Related U.S. Application Data

(63) Continuation-in-part of application No. 17/175,035, filed on Feb. 12, 2021.

(51) Int. Cl.
*E05F 15/684* (2015.01)
*E05F 13/00* (2006.01)
*E05D 13/00* (2006.01)

(52) U.S. Cl.
CPC ..... *E05F 15/684* (2015.01); *E05D 13/003* (2013.01); *E05Y 2900/106* (2013.01)

(58) Field of Classification Search
CPC ..... E05Y 2900/106; E05Y 2900/00; E05Y 2201/21; E05F 1/02; E05F 15/72; E05F 15/668; E05F 15/673; E05F 15/684; E05F 11/54; E05D 13/003
See application file for complete search history.

(56) References Cited

U.S. PATENT DOCUMENTS 3,481,074 A 12/1969 Moss
3,764,875 A 10/1973 Harris
3,816,782 A 6/1974 Dow et al.
4,885,872 A 12/1989 Chang et al.
5,010,688 A 4/1991 Dombrowski et al.
5,203,392 A * 4/1993 Shea ..... E06B 9/74 160/310
5,221,869 A 6/1993 Williams et al.
(Continued)

FOREIGN PATENT DOCUMENTS

WO 2018217332 A1 11/2018

OTHER PUBLICATIONS

The Chamberlain Group, Inc., Premium Series 3240 1/2 HP Screw Drive Garage Door Opener, 2007 LM 3240 06/07, Elmhurst, IL, (publication date unknown).

*Primary Examiner* — Justin B Rephann
(74) *Attorney, Agent, or Firm* — Haynes and Boone, LLP

(57) ABSTRACT

A movable barrier operator release mechanism includes an operator chassis having a first side. A shaft extending in a first direction from the first side of the chassis. A brake assembly coupled to the chassis and the first shaft extends into the brake assembly. The brake assembly includes a lever, mounted to a mounting plate of the brake assembly on end and freely movable at the other end. A cable attached to the lever that when pulled pivots the lever about its mounting point. When moved, the lever disengages the brake assembly allowing for free movement of the movable barrier.

20 Claims, 9 Drawing Sheets

(56) References Cited

U.S. PATENT DOCUMENTS 5,355,927 A * 10/1994 McKeon ..... E06B 9/82 160/310
5,568,704 A * 10/1996 Williams ..... E05D 15/38 49/362
5,605,185 A * 2/1997 McKeon ..... A62C 2/10 160/133
5,664,372 A * 9/1997 Williams ..... F16F 15/10 49/362
5,761,850 A 6/1998 Lhotak et al.
5,893,234 A * 4/1999 McKeon ..... E06B 9/68 49/7
6,070,641 A * 6/2000 Budetti ..... E06B 9/84 74/411.5
6,422,965 B1 * 7/2002 Balli ..... E06B 9/74 160/310
6,484,784 B1 * 11/2002 Weik, III ..... A62C 2/24 49/7
6,712,116 B2 * 3/2004 Beaudoin ..... E05F 11/54 160/188
6,847,136 B2 1/2005 Mattson
6,952,061 B2 10/2005 Mogi et al.
6,986,378 B2 * 1/2006 Beaudoin ..... E06B 9/62 160/302
7,055,283 B2 * 6/2006 Hsieh ..... E05F 15/40 160/188
7,061,197 B1 6/2006 Mullet et al.
7,240,582 B1 * 7/2007 Manaras ..... E05F 15/692 74/567
7,282,883 B2 10/2007 Mullet et al.
7,576,504 B2 8/2009 Mullet et al.
7,592,726 B2 9/2009 Heyder
8,397,787 B1 * 3/2013 Daus ..... E05F 15/71 160/1
8,985,181 B2 * 3/2015 Hsieh ..... E06B 9/68 160/310
9,038,800 B2 5/2015 Dang
9,234,377 B2 1/2016 Schatz et al.
9,890,575 B2 2/2018 Tehranchi
10,000,960 B2 6/2018 Angiuli et al.
10,563,446 B2 2/2020 Tehranchi
2013/0074409 A1 * 3/2013 Hsieh ..... E06B 9/80 49/139
2013/0152478 A1 * 6/2013 Lhotak ..... E06B 9/70 49/358

* cited by examiner

RELEASE MECHANISM FOR A DOOR OPERATOR

CROSS-REFERENCE TO RELATED APPLICATIONS

This patent application is a continuation-in-part of U.S. patent application Ser. No. 17/175,035 filed on Feb. 12, 2021, titled "Door Operator with Isolated Components," which is hereby incorporated by reference in its entirety.

TECHNICAL FIELD

The present disclosure relates generally to movable barrier opener systems for opening and closing garage doors, gates, and other movable barriers.

BACKGROUND

Movable barriers, such as upward-acting sectional or single panel garage doors, residential and commercial rollup doors, and slidable and swingable gates, are used to alternatively allow and restrict entry to building structures and property. These barriers are driven between their respective open and closed positions by motors or other motion-imparting mechanisms, which are themselves controlled by barrier moving units, sometimes referred to as "movable barrier operators," and in the specific case of a door, as "door operators," and in the even more specific case of a garage door, as "garage door operators." Garage door operators are effective to cause the DC or AC motor, and accompanying motor drive assembly, to move the associated garage door, typically between its open and closed positions.

There are times that these barriers may need to be operated manually, such as in the event of a power outage. The force required to manually operate a barrier may be reduced by conventional release mechanisms. Generally, manual operation of a barrier is possible after disengaging the motor from the output shaft and/or engaging a hoist chain wheel. An example jackshaft operator may employ a mid-gear train style release mechanism that physically isolates the output shaft from the motor shaft. An example hoist operator may employ a series of levers to engage a chain wheel that is coupled to the output shaft. In both cases, the mechanisms are relatively complex with many moving parts leaving room for improvement.

This disclosure is directed to innovative and new release mechanism designs for operators including jackshaft and hoist operators that use fewer parts and improve the efficiency of the release mechanism. This may lead to lower manufacturing cost, increased reliability, fewer interfacing parts reducing friction noise, and/or greater customer satisfaction.

SUMMARY

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

In an aspect, a jackshaft operator release mechanism for manual operation of a movable barrier may include a motor mounted to a metal frame. The motor may have a brake assembly mounted to the metal frame such that a shaft of the motor is disposed through the brake assembly allowing the brake assembly to arrest rotation of the motor shaft. In an aspect, the brake assembly may include a brake release lever operable to disengage the brake assembly thereby allowing the motor shaft to freely rotate. In aspect a release bracket may be coupled to the metal frame and disposed over the brake release lever. A brake release cord may be coupled to the brake release lever and disposed through the release bracket providing with the release bracket providing the necessary leverage to move the brake release lever. With the brake assembly disengaged, manual operation of the barrier may be permitted, such as by lifting the barrier.

In another aspect, a hoist operator release mechanism for manual operation of a movable barrier may include a motor mounted to a metal frame. The motor may have a brake assembly mounted to the metal frame such that shaft of the motor is disposed through the brake assembly allowing the brake assembly to arrest the rotation of the motor shaft. In an aspect the brake assembly may include a brake release lever operable to disengage the brake assembly permitting the motor shaft to freely rotate. A transfer shaft may be operable for transfer rotation of the motor shaft to an output shaft to move the barrier. In an aspect, the transfer shaft may include a cross pin passing through the transfer shaft transverse to the axial direction of the transfer shaft. A spring may be disposed around the transfer shaft between the metal frame and the cross pin. A chain wheel, including pins, may be disposed around the transfer shaft adjacent the spring and between the spring and the metal frame. A release cam lever may be disposed around the transfer shaft adjacent the chain wheel and between the chain wheel and the metal frame. In an aspect, the release cam lever is operable to transfer a rotational movement provided by a release cord to a linear movement along the axial direction of the transfer shaft. The release cam lever may move the chain wheel away from the metal frame, compressing the spring, and the pins of the chain wheel engaging the cross pin. Additionally, the release cam lever may engage the brake release lever to disengage the brake assembly. With the chain wheel engaged and the brake assembly disengaged, a chain may be used to manually operate the barrier.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, serve to explain the principles of the present disclosure.

Figure 1:
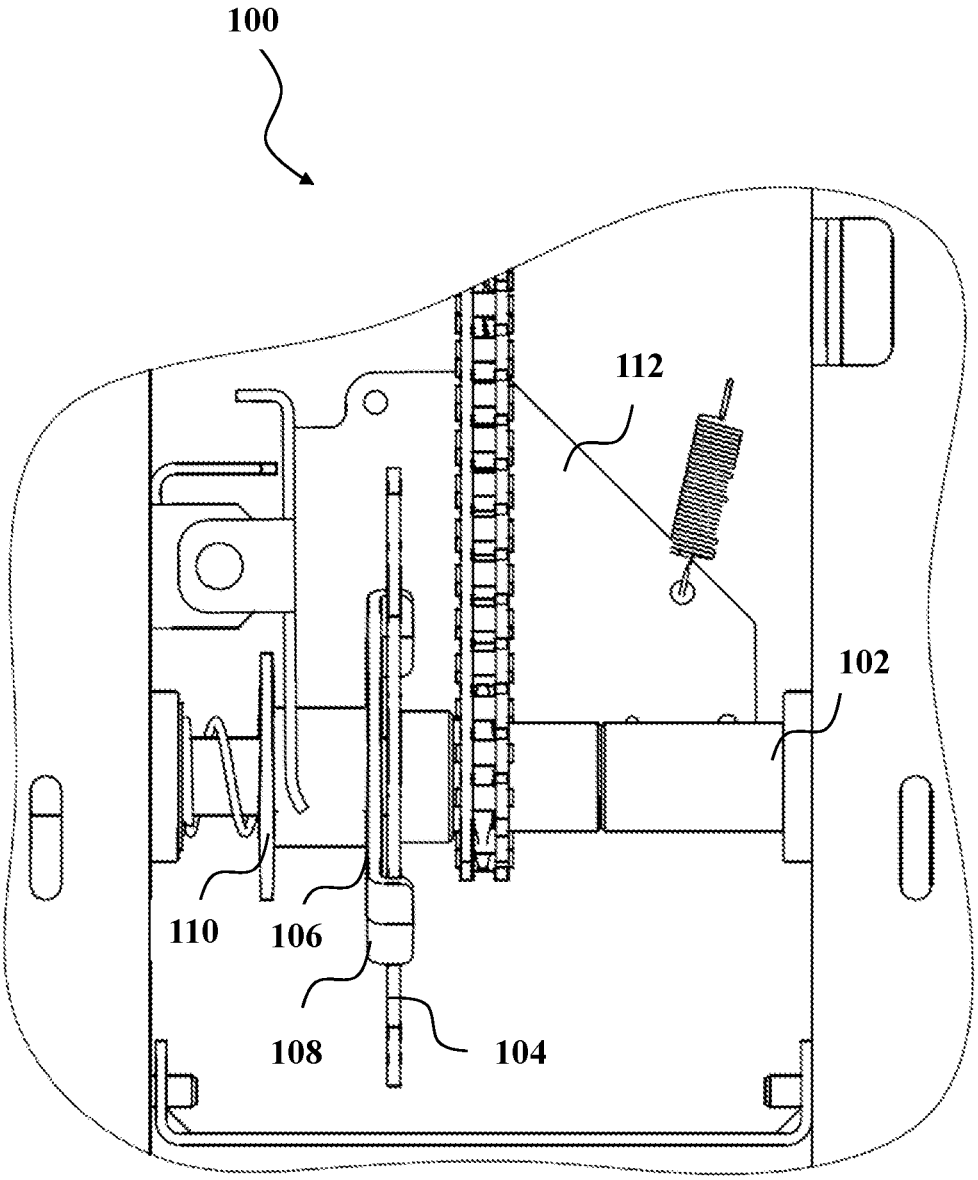
PRIOR ART FIG. 1
FIG. 1 is an illustration of a conventional jackshaft operator mid-gear train disconnect mechanism enabling manual operation of a garage door.

These Figures will be better understood by reference to the following Detailed Description.

DETAILED DESCRIPTION

For promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

With reference to FIG. 1, there is depicted an illustration of a conventional jackshaft operator having a mid-gear train disconnect mechanism 100 for manual operation of a garage door. In order to operate the garage door manually, a significant force is required to lift the weight of the door and back drive the motor (i.e. overcome the belt tension and pulley ratio between the motor and output shaft). While the torsion spring aids in lifting the weight of the door, the torsion spring must also provide the force that is required to back drive the motor. Generally, the solution to overcome this is to remove the motor from the system when manually operating a garage door. The most common method used to remove the motor is a mid-gear train disconnect. That is, disconnect the motor at the transfer shaft.

The mid-gear train disconnect mechanism 100 illustrated in FIG. 1 includes a transfer shaft 102 operable to drive an output shaft. Transfer shaft 102 has a first plate 104 coupled to one end that contacts a second plate 106 and receives teeth 108 of the second plate 106. The second plate 106 is coupled to a clutch shaft 110. When the clutch shaft 110 rotates the teeth 108 engage with the first plate 104 causing the transfer shaft 102 to rotate. A rope may be attached to a corner of a release lever 112 operable to pivot the release lever 112. When the rope is pulled, the release lever 112 rotates about a pivot point and pushes clutch shaft 110 which disengages the teeth 108 from the first plate 104. This release mechanism physically separates the clutch shaft 110 on one side from the transfer shaft 102 on the other side. This separation disengages the motor shaft from the output shaft to avoid back driving the motor.

Figure 2:
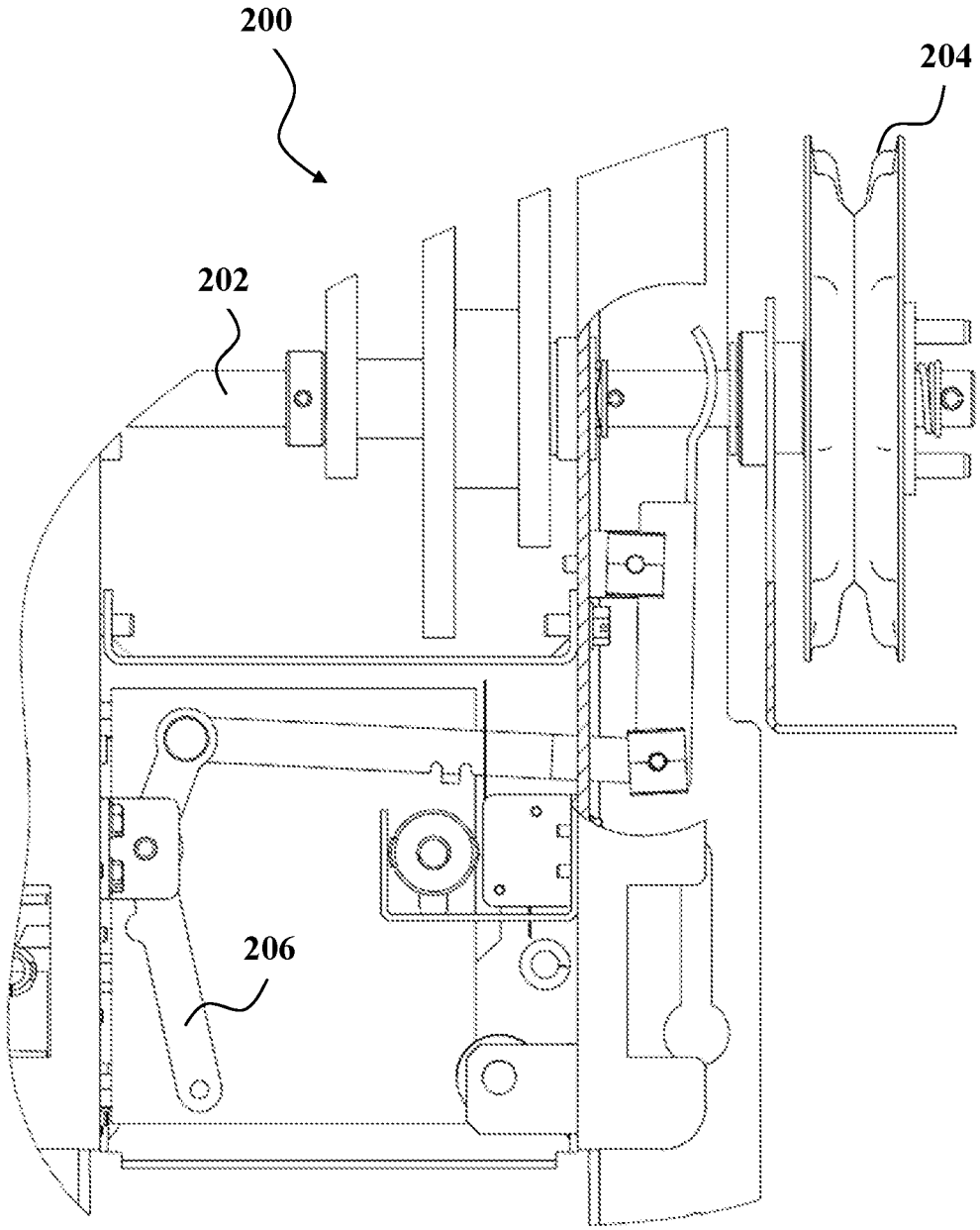
PRIOR ART FIG. 2
FIG. 2 is an illustration of a conventional hoist operator chain wheel engagement mechanism enabling manual operation of a garage door.

FIG. 2 depicts a conventional hoist operator chain wheel engagement mechanism 200 for manual operation of a garage door. A transfer shaft 202, operable to drive an output shaft, is shown. A chain wheel 204 is coupled to an end of the transfer shaft 202. A chain may be wrapped around the chain wheel for manually operating a garage door. A lever 206 is depicted where one end of the lever may be connected to a rope and the other end of the lever is disposed adjacent the chain wheel. When the rope is pulled, the lever 206 presses against, and moves, the chain wheel 204 which engages the chain wheel 204 with the transfer shaft 202. In this manner, the chain may be pulled, rotating the chain wheel 204 that is now coupled to the transfer shaft 202. The transfer shaft 202 rotates with the chain wheel 204 and drives the output shaft.

Persons of ordinary skill in the art will note the number of moving parts required for each of these conventional release mechanisms to function properly. The number of parts provides multiple points of failure within the release mechanism as well as added cost and weight to the operator. Additionally, the number of parts increases the potential points of vibration within the system, thereby increasing noise within the system.

Figure 3:
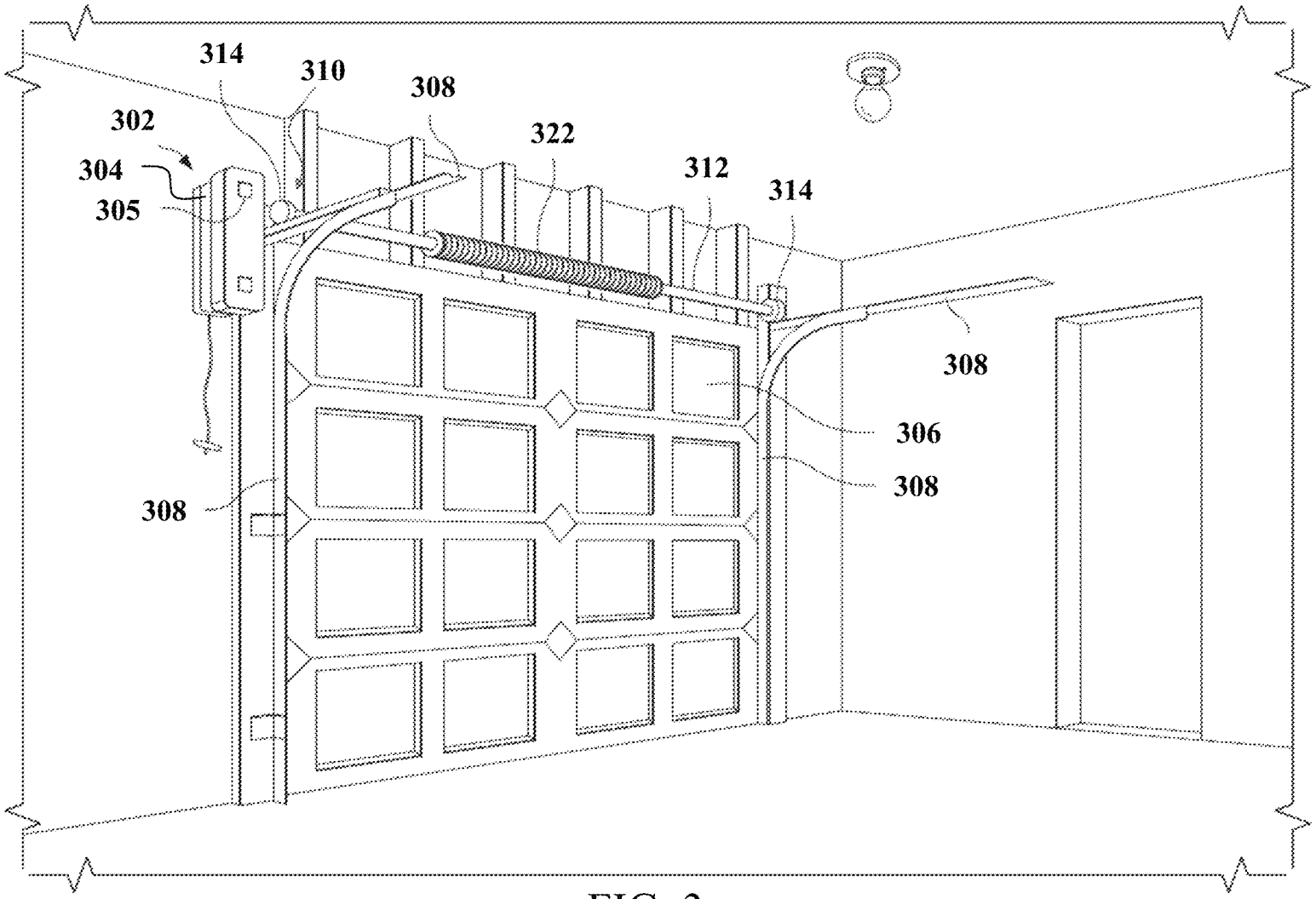
FIG. 3 is a perspective illustration of material structural components of a jackshaft operator installed in a garage with a sectional type garage door, according to one example implementation.

FIG. 3 illustrates material structural components for moving a garage door according to some embodiments of the present disclosure. Depicted is an exemplary operator for moving a barrier. In this example, the operator is a operator 302, including a chassis 304 and an electric box 305, operable to move a barrier shown as a garage door 306 along guide rails 308 to open and close the garage door 306. As depicted, the garage door 306 as a conventional upward acting sectional door being moved between open and closed positions along guide rails 308. Other types of garage doors are contemplated such as single panel doors, rollup doors, etc. In some embodiments, the operator 302 may be a jackshaft operator. In some embodiments, the operator 302 may be a hoist operator, or other operator.

The chassis 304 encloses a jackshaft motor assembly. The electric box 305 encloses a door control module and an operator control module. The jackshaft motor assembly includes, among other components, (i) a motor adapted to move the garage door in the conventional manner known by one of ordinary skill in the industry, and (ii) an absolute position sensor that monitors or measures rotation of the output shaft of the unit and communicates signals based on the measurements indicative of, the extent and direction of rotation of the rotatable output shaft of the unit, and therefore indicative of the extent and direction of travel of the garage door 306 between travel limits.

The motor is operatively coupled to a drive assembly 310. The motor and drive assembly 310 are effective to impart movement to the garage door 306 in accordance with door commands remotely and/or proximately transmitted to operator control module and thereafter to the motor. The drive assembly 310 may be any of the standard and conventional drive assemblies available on the market that are suitable to move the garage door 306 in response to the motor. In the example described herein, the drive assembly 310 is a part of a jackshaft drive assembly.

The operator 302 is installed adjacent a garage door 306 and operable to open and close the garage door. The chassis 304 of the operator 302 is shown adjacent the drive assembly 310 which may include a torsion tube 312 and one or more cable drums 314 rigidly affixed to the torsion tube 312. These may be rotatably driven by the operator 302. One or more cables 316 may be wound about the cable drums 314 and have their free ends 318 attached at or adjacent a bottom edge 320 of the garage door 306. In some embodiments, the torsion tube 312 forms a part of or is coaxial with the output shaft of the operator 302. In other embodiments, the torsion tube 312 may be laterally offset from the output shaft of the operator 302 and use a chain and sprockets to couple the operator 302 to the torsion tube 312. Rotation of the output shaft of the operator 302 rotates the torsion tube 312 and the cable drums 314. Rotation in a direction to wind the cable around the cable drums 314 results in the garage door 306 being raised to the open position.

In this embodiment, the torsion tube 312 of the drive assembly 310 extends horizontally and is directly coupled to, and adapted to be rotatably driven by, the operator 302 in either a clockwise or counterclockwise direction. A torsion spring 322 extends around the torsion tube 312.

When the operator 302 is instructed by a controller to open the garage door 306, the torsion tube 312 and the connected cable drums 314 are rotated by the operator 302 in a direction so as to wind the cable(s) 316 onto the cable drum(s) 314, thereby lifting the garage door 306 to its open position. When the operator 302 is instructed by the controller to close the garage door 306, the torsion tube 312 and connected cable drums 314 are rotated by the operator 302 in the opposite direction so that cable(s) 316 may be payed out, thereby permitting the garage door 306 to be closed. The torsion spring 322 provides a counterbalance to aid in the door 306 being moved to its closed position.

Figure 4:
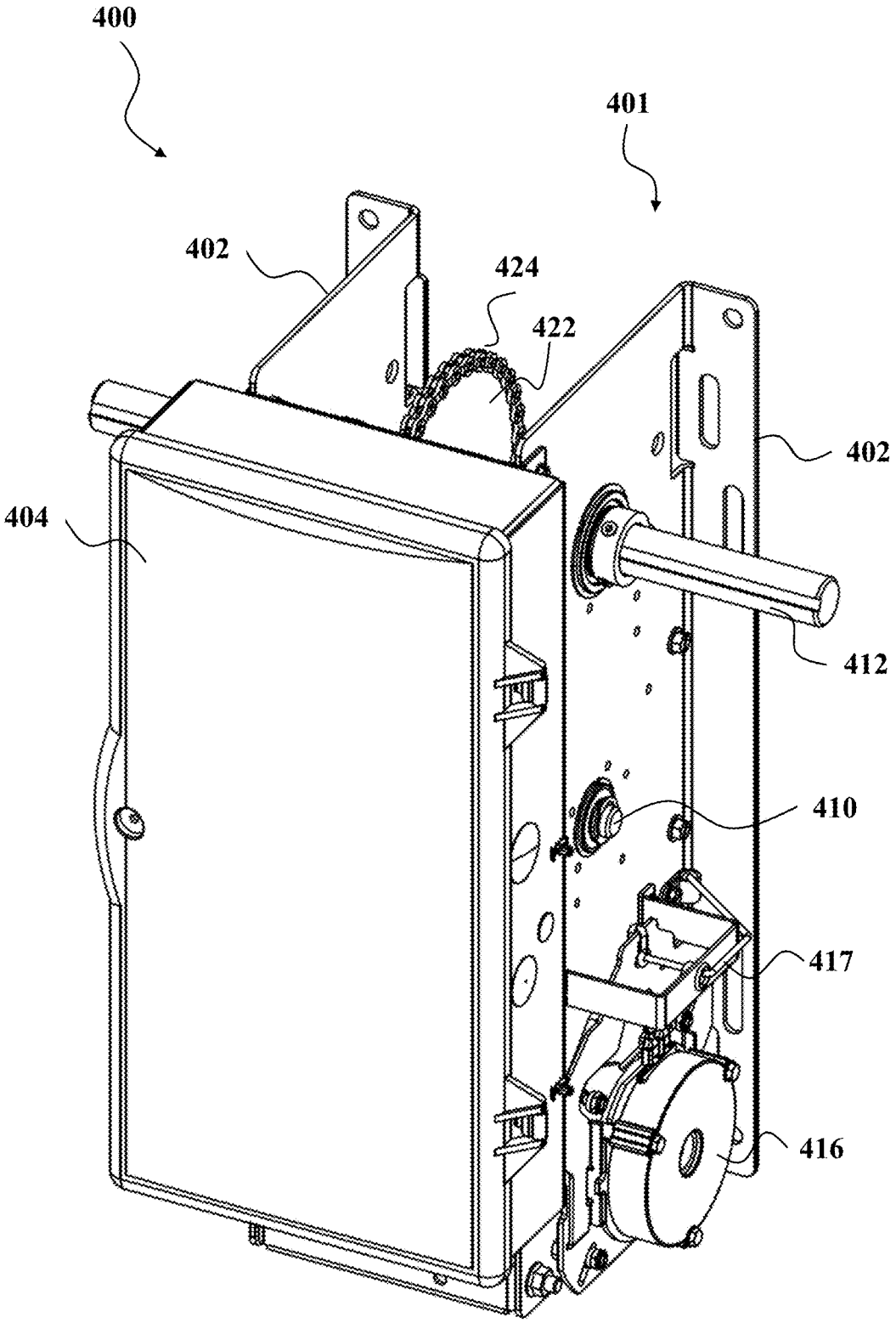
FIG. 4 is a perspective illustration of a jackshaft motor drive assembly for moving a movable barrier, according to one example implementation.

FIG. 4 depicts a perspective view of an exemplary operator 400 according to some embodiments of the present disclosure. The operator 400 may be the operator 302 in FIG. 3. In the depicted embodiment, the operator 400 is a jackshaft operator. In some embodiments, the operator 400 may be a hoist operator or other operator. In the depicted embodiment, the operator 400 includes a chassis 401 including side panels 402 for mounting the various components of a motor assembly and an electric box 404 mounted to side panels 402. In some embodiments, side panels 402 may be metal panels including mounting points and holes configured to receive the different components of the operator 400. In some embodiments, the side panels 402 may be sheet metal. The motor assembly may include a motor having a motor shaft (not visible in FIG. 4), a transfer shaft 410, and an output shaft 412. In some embodiments, the motor may have dual motor shafts. The output shaft 412 may be coupled to torsion tube 312 (FIG. 3) for operating the garage door 306. In some embodiments, the output shaft 412 may directly connected to torsion tube 312. In some embodiments, the output shaft 412 may be coupled to torsion tube 312 by a chain or belt mechanism. The motor is mounted between bottom portions of the side panels 402. A motor belt pulley is coupled to one of the motor shafts of the motor. A brake 416 is coupled to the motor shaft of motor. A brake release mechanism 417 may be connected to the brake 416 operable to release the brake to allow for manual operation of the door. In some embodiments, the motor belt pulley may be mounted one side of the operator 400, such as for example the left side. In some embodiments, the motor belt pulley may be mounted on the other side of the operator 400, such as for example the right side. The side on which the motor belt pulley is installed may be determined by where the operator 400 is installed. In some embodiments, an anti-rotation stud may prevent the motor from rotating within the chassis during operation of the operator 400. Some implementations of the operator 400 may include features described in U.S. patent application Ser. No. 17/175,035, filed Feb. 12, 2021, incorporated herein by reference.

Figure 5:
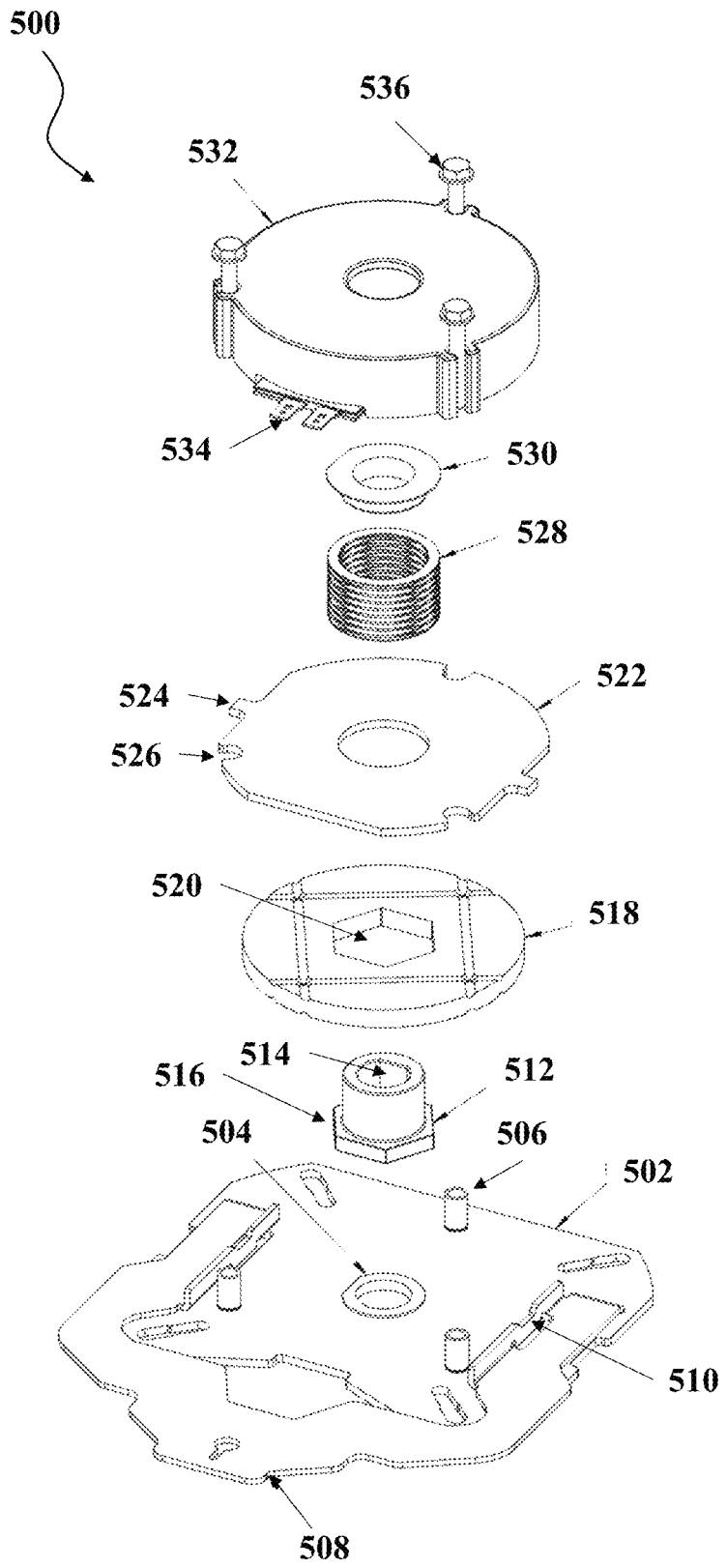
FIG. 5 is an exploded perspective illustration of a brake assembly for an operator, such as a jackshaft or hoist operator, according to one example implementation.

With reference to FIG. 5 there is depicted an exploded perspective illustration of an exemplary brake assembly for use in a jackshaft or hoist type operator. As illustrated, the brake assembly 500 includes a mounting plate 502 including a first spacer 504, standoffs 506, and a brake release lever 508. Standoffs 506 may be threaded to receive a fastener, such as for example a screw, bolt, etc. In some embodiments, standoffs 506 may be smooth allowing for a fastener to pass through to be secured on a backside of the mounting plate 502. Brake release lever 508 includes a notch feature 510 which may be a depression, a slot, or other indentation. The brake assembly 500 further includes a collar 512 having a central opening 514 and a base 516 having a non-circular perimeter, a friction pad 518 having an opening 520 that is non-circular and matches the perimeter shape of the base 516, an armature plate 522 having tabs 524 and cutouts 526, a spring 528, and a second spacer 530. The armature plate 522 may include a ferromagnetic material to be acted upon by a magnetic force. The friction pad 518 may include a material designed to prevent slipping when the armature plate 522 and the friction pad 518 are pressed together. In some embodiments, the friction pad 518 may include a compound resin having a copper wire facing. In some embodiments, the friction pad 518 may include a ceramic material. Finally, the brake assembly 500 includes a coil assembly 532 including coiled wires therein (not shown) with contacts 534 connected to the coiled wires and fasteners 536 for coupling the coil assembly 532 to the mounting plate 502 through standoffs 506.

When brake assembly 500 is assembled, a motor shaft may be disposed through the opening 514 of collar 512, the opening 520 of friction pad 518, through an opening in armature plate 522, and into, but not through, an opening in spring 528. The opening 514 may have a non-circular inner profile (shown here as having a flat surface) and the motor shaft may have a non-circular outer profile (having a flat surface in this implementation) that interfaces with the non-circular inner profile (e.g., flat surface) of the opening 514. This interface couples the motor the rotation of the shaft to the collar 512 so that the collar 512 rotates when the motor shaft rotates. The base 516 of collar 512 may fit over the first spacer 504 one side, allowing the collar 512 to freely rotate, and may be seated inside the opening 520 of friction pad 518. In the depicted embodiment, both the base 516 and the opening 520 have a non-circular shapes, shown in this example as hexagonal shapes. Other shapes are contemplated, such as square, triangular, octagonal, etc. In this way, the rotation of collar 512 is coupled to the friction pad 518 with the collar 512 rotating the friction pad 518 as the motor shaft rotates.

The opening in the armature plate 522 fits over the collar 512 so that the armature plate 522 is disposed adjacent to friction pad 518 in the brake assembly 500. In this configuration, the armature plate 522 may physically contact the friction pad 518, but is not coupled to friction pad 518. When fully assembled, the standoffs 506 of the mounting plate 502 may be disposed adjacent to and through the cutouts 526 of the armature plate 522. In this way, the standoffs 506 may prevent the armature plate from rotating when cutouts 526 physically contact standoffs 506. The spring 528 is disposed adjacent to and physically contacting the armature plate 522. The collar 512 may extend through the opening in the armature plate 522 and into the opening in the spring 528, but not through the spring 528. In this way, the collar 512 may prevent the lateral displacement of the spring 528. In some embodiments, a different mechanism may be used for preventing the lateral displacement of the spring 528. The second spacer 530 may include a lip which permits a portion of the second spacer 530 to be seated within the spring 528 while the lip of the second spacer 530 rests on an outer surface of the spring 528. Assembly of the brake assembly 500 is completed when the coil assembly 532 is fastened to mounting plate 502 using fasteners 536.

During normal operation, an electric current may be used to engage and disengage the brake assembly to either permit or arrest rotation of the motor shaft. The electric current may be provided to coil assembly through contacts 534.

When no electric current is applied to contacts 534, the brake assembly 500 is engaged, arresting rotation of the motor shaft thereby stopping movement of the garage door. Generally, when the motor is not running, the brake assembly 500 is engaged, inhibiting movement. In this state, spring 528 presses against an inside surface of the coil assembly 532 on one end and into the armature plate 522 on the other end. This force from the spring 528 presses the armature plate 522 against, and physically contacting, the friction pad 518. In this configuration, the friction between friction pad 518 and armature plate 522 permits little, to no, slipping of the friction pad 518 with respect to the armature plate 522. The cutouts 526 of the armature plate 522 physically contacting the standoffs 506 prevent the armature plate 522 from rotating. In this way, the friction pad 518 is prevented from rotating, which prevents the collar 512 from rotating, and ultimately the motor shaft is prevented from rotating, thereby preventing movement the garage door. This maintains the operator at the current position and prevents the garage door from opening or closing without the use of significant external force.

When an electric current is applied to contacts 534, the brake assembly 500 is disengaged, thereby permitting rotation of the motor shaft and allowing movement of the garage door. Generally, when the motor powered and running (e.g. the motor shafts are rotating) a current is applied to contacts 534 to disengage the brake assembly 500. When the current is applied to contacts 534 an electromagnetic field is generated by the coils inside the coil assembly 532. The electromagnetic field draws the armature plate 522 towards the coil assembly 532, compressing the spring 528 in the process. In this state, the armature plate 522 is no longer in contact with the friction pad 518. The friction pad 518, collar 512, and the motor shaft may rotate freely to move the garage door.

Figure 6:
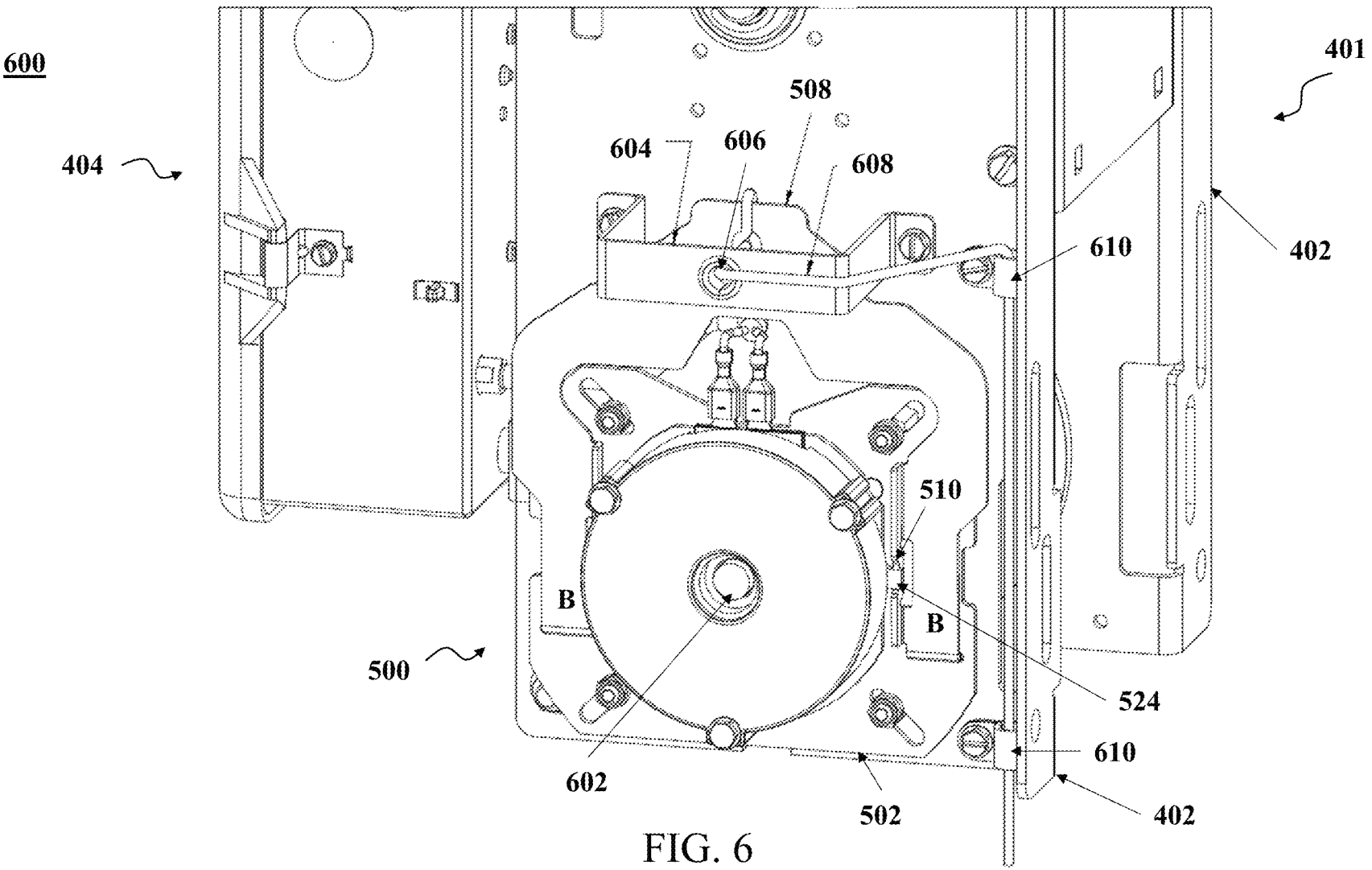
FIG. 6 is a perspective illustration of a brake release mechanism in a disengaged position for an operator such as a jackshaft operator, according to one example implementation.

With reference to FIG. 6, there is illustrated a brake release mechanism for a jackshaft operator according to embodiments of the present disclosure. As can be seen in the illustration, the jackshaft brake release mechanism 600 is not require a mid-gear train disconnect and does not have as many parts as the conventional jackshaft mid-gear train disconnect. FIG. 6 illustrates a brake assembly 500 including brake release lever 508 and tabs 524 as discussed above with respect to FIG. 5. As depicted, brake release lever 508 is coupled to mounting plate 502 at points B, around which the brake release lever can pivot. Brake assembly 500 is coupled to the chassis 401 of a jackshaft operator, such as operator 400 described above with respect to FIG. 4. Specifically, brake assembly 500 is mounted on a side panel 402 of the jackshaft operator and over a motor shaft 602. A release bracket 604 is coupled to the side panel 402 of the chassis 401, adjacent to, and disposed over, a top portion of brake release lever 508. Release bracket 604 includes an opening 606. A release cord 608 may be passed through the opening 606 and attached to an upper portion of the brake release lever 508. In the depicted embodiment, the release cord 608 may be secured to the side panel 402 by brackets 610 which guide the release cord 608 around the brake assembly 500 and toward the ground for use. In some embodiments, brackets 610 may be removed and the release cord 608 may extend through the release bracket 604, over the brake assembly 500, and down toward the ground for use.

As depicted in FIG. 6, the jackshaft brake release mechanism 600 is not engaged, or is not active. In this configuration, the brake assembly 500 is engaged and operates as described above with respect to FIG. 5. The garage door may not be manually operated without requiring significant force to overcome the braking provided by the brake assembly 500.

To activate, or engage, the jackshaft brake release mechanism 600 the release cord 608 is pulled, creating tension in the release cord 608, and may be held or tied off to maintain the tension in the release cord 608. Pulling the release cord 608 pivots the brake release lever 508 about point B. This moves the upper portion of the brake release lever 508 away from the side panel 402 and toward the release bracket 604. This movement is sufficient for the notch features 510 of the of the brake release lever 508 to engage the tabs 524 of the armature plate 522. The brake release lever 508 pushes, and moves, the armature plate 522, separating the armature plate 522 from the friction pad 518 and compressing the spring 528. This mechanism disengages the brake assembly 500 similar to the process described above except that a mechanical force is used instead of an electromagnetic force. At this point, the motor shaft may rotate freely, allowing the garage door to be operated manually.

To deactivate the jackshaft brake release mechanism 600, the tension in the release cord 608 may be released by untying and releasing the release cord 608. With the tension in the release cord 608 released, the spring 518 inside the brake assembly 500 pushes the armature plate 522 moving it back to its original position pressed against the friction pad 518. The tabs 524 of the armature plate 522 move the brake release lever 508 back to its original position. In this state, the brake is fully re-engaged, and the brake release is disengaged.

Persons of ordinary skill in the art will recognize the simplicity and efficiency of this design. The new jackshaft brake release mechanism 600 uses fewer parts than conventional designs by implementing the release in a new and innovate manner. The jackshaft brake release mechanism 600 contains fewer parts to wear out and fewer parts that produce noise. Additionally, there is a cost savings in this design because fewer parts are used.

Figure 7A:
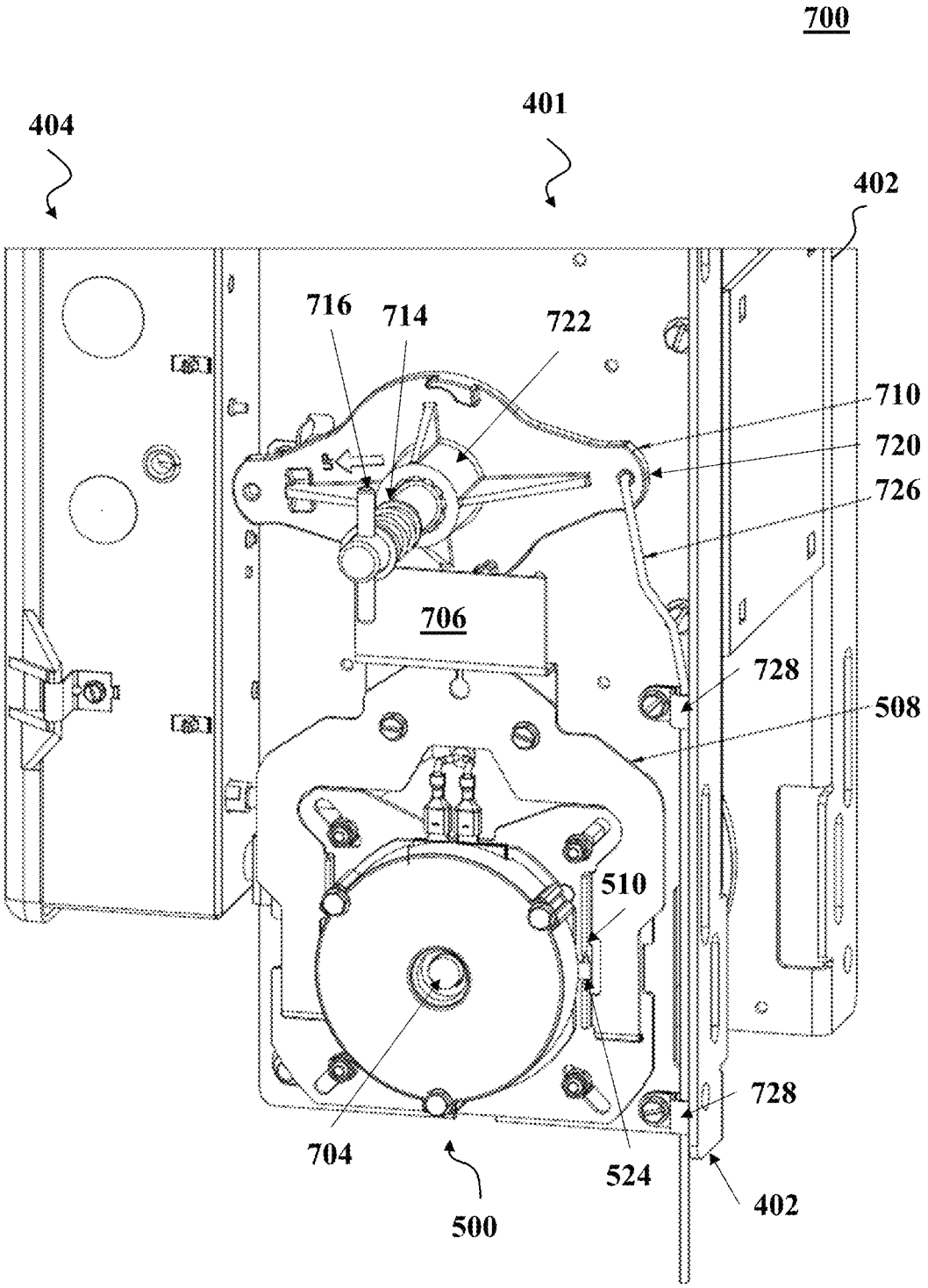
FIG. 7A is a perspective illustration of a brake release mechanism for an operator such as a hoist operator, according to one example implementation.
Figure 7B:
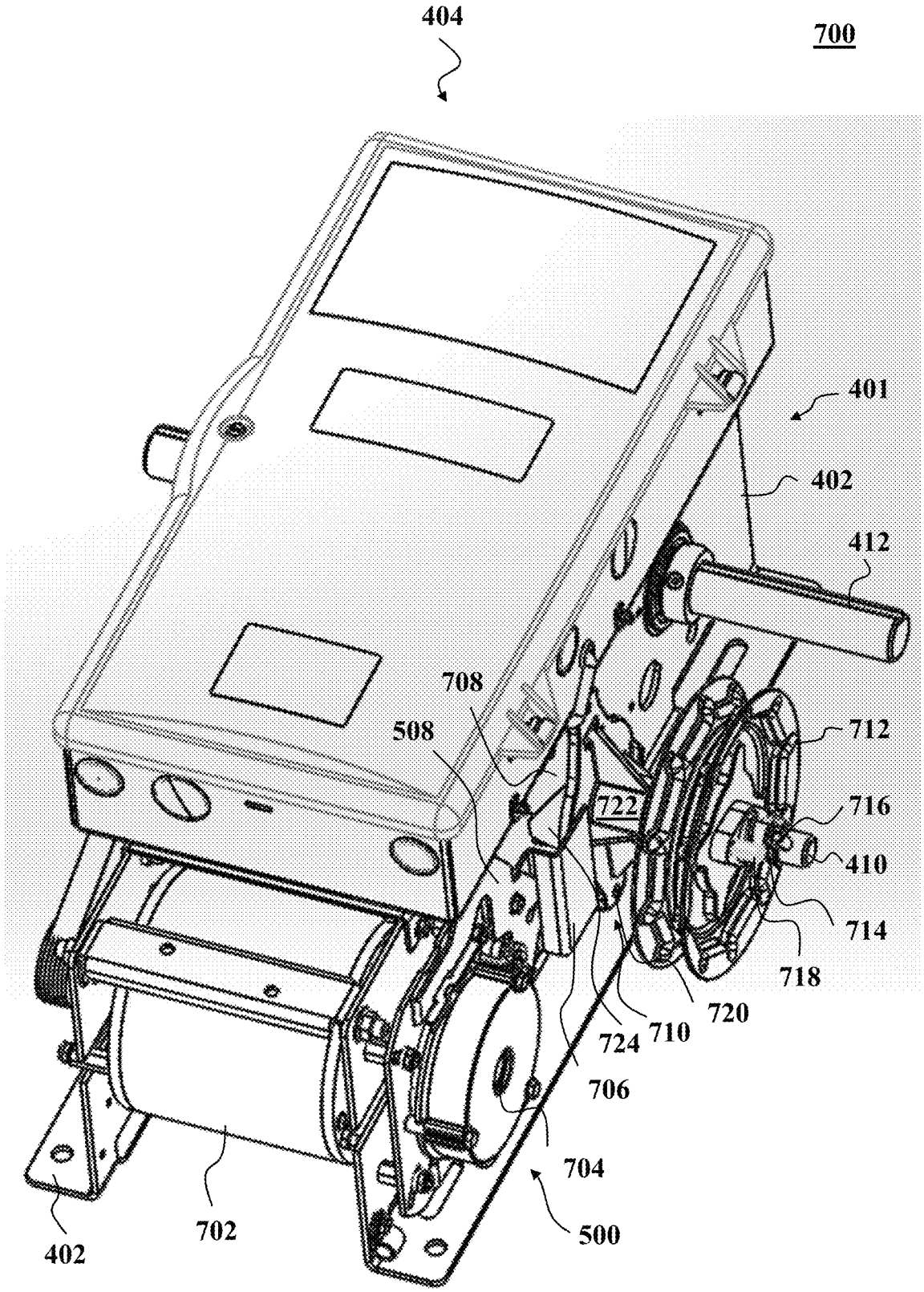
FIG. 7B is a perspective illustration of a brake release mechanism with the brake release not active for an operator such as a hoist operator, according to one example implementation.
Figure 7C:
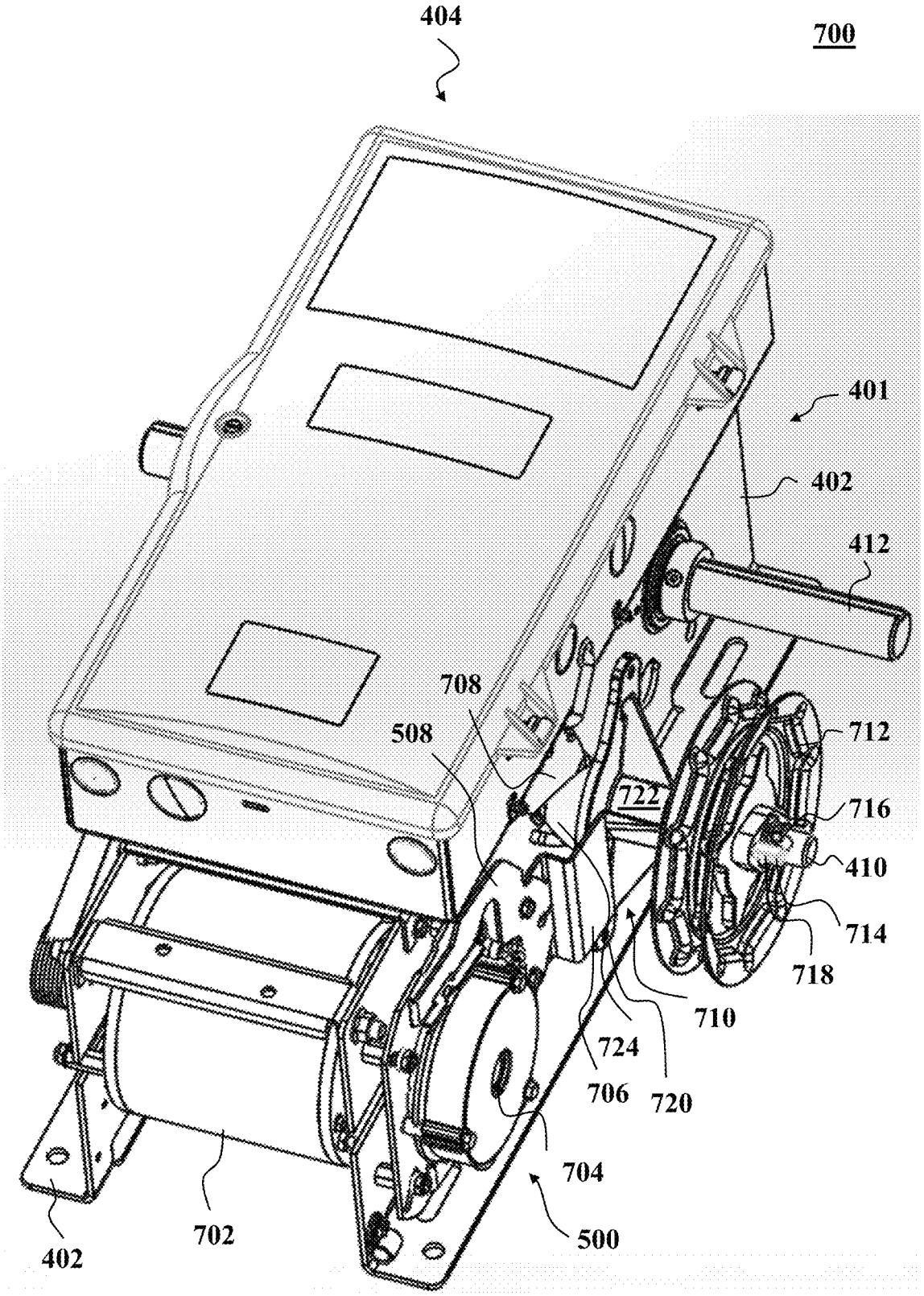
FIG. 7C is a perspective illustration of a brake release mechanism with the brake release activated for an operator such as a hoist operator, according to one example implementation.

With reference to FIGS. 7A, 7B, and 7C, depict perspective illustrations of an exemplary hoist brake release mechanism according to an example embodiment. FIG. 7A depicts components of the hoist brake release mechanism without the chain wheel to better display certain aspects of the brake release mechanism. FIG. 7B depicts the hoist brake release mechanism in a disengaged, or not activate, state. FIG. 7C depicts the hoist brake release mechanism in an engaged, or active, state. The hoist operator depicted may be the hoist operator 400 described above with respect to FIG. 4 with the addition of a chain wheel and additional parts, as described below, for the release mechanism.

Depicted in FIGS. 7A-7C is a chassis 401, in these illustrations chassis 401 includes side panels 402. An electric box 404 is coupled to the chassis 401. A brake assembly 500 is mounted to a side panel 402 of the chassis 401. A motor 702 is mounted between side panels 402 with a motor shaft 704 extending through a side panel 402 and into the brake assembly 500. In the depicted embodiment, another motor shaft 704 extends through the other side panel 402 and is operable to drive transfer shaft 410 and output shaft 412. The brake assembly 500 includes brake release lever 508 which includes a release lever extension 706.

The hoist brake release mechanism 700 includes a cam base 708, a release cam lever 710, and a chain wheel 712. The cam base 708 having sloped edges is coupled to a side panel 402 of the chassis 401, physically contacting the side panel 402. Transfer shaft 410 passes through side panel 402, cam base 708, release cam lever 710, and chain wheel 712. A spring 714 is disposed over the exposed transfer shaft 410, adjacent the chain wheel 712. A cross pin 716 is disposed through the transfer shaft transverse to the axial direction of the transfer shaft 410. Cross pin 716 may be operable to hold spring 714 over the transfer shaft, between the cross pin 716 and the chain wheel 712. Pins 718 are coupled to chain wheel 712 and are operable to engage cross pin 716 when spring 714 is compressed.

As depicted in FIGS. 7A-7C, the release cam lever 710 is longer in a first direction than in a second direction allowing for a release cord 726 to apply a torque to the release cam lever 710. The release cord 726 may be attached to point 720 on the release cam lever 710. The release cam lever 710 may include a hollow body 722, operable for moving chain wheel 712, attached to one face of the release cam lever 710. The release cam lever 710 may include a hollow protrusion 724 having sloped edges, attached to an opposing second face, through which transfer shaft 410 may pass. The sloped edges of the hollow protrusion 724 may interface with sloped edges of the cam base 708 allowing the release cam lever 710 to slide over the cam base 708 along the sloped edges. This configuration is operable to translate rotary motion around the axis of the transfer shaft 410 to a linear motion along the axis of the transfer shaft 410. As illustrated, when the release cam lever 710 is rotated clock-wise the sloped edges of the hollow protrusion 724 slide up and along the sloped edges of the cam base 708 thereby pushing the release cam lever 710 away from the side panel 402 and toward the chain wheel 712. In some embodiments, a release cord attached to point 720 is pulled, producing a torque on the release cam lever 710 that causes the clock-wise rotation of the release cam lever 710.

The brake release is activated, or engaged, by the linear motion of the release cam lever 710 along the axis of the transfer shaft 410 in two ways. First, the release cam lever 710 moves chain wheel 712 along the axis of the transfer shaft 410, compressing spring 714, so that the pins 718 physically contact the cross pin 716. This couples the chain wheel 712 to the transfer shaft 410 so that any rotation imparted on the chain wheel 712, such as by pulling a chain, is imparted on the transfer shaft 410. In this way, a chain may be used for manual operation of the garage door. Second, the release cam lever 710 physically contacts the release lever extension 706 and moves the brake release lever 508 away from the side panel 402. As the brake release lever 508 moves it engages the tabs 524 of the armature plate 522, moving the armature plate 522 away from the friction pad 518, thereby disengaging the brake assembly 500. In this configuration, as depicted in FIG. 7B, the motor shaft 704 may rotate freely as the chain wheel 712 is rotated.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

The present disclosure is directed to a movable barrier operator release mechanism which includes a first side panel that has a first side and an opposing second side. The movable barrier operator release mechanism further includes a motor, including a first shaft, disposed at the first side of the first panel. A brake assembly is disposed at the second side of the first panel. The first shaft extends through the first side panel and into the brake assembly. The brake assembly may stop the rotation of the first shaft when engaged. A first lever, operable to disengage the brake assembly, is disposed between the brake assembly and the first side panel. The brake assembly may include a mounting plate. A first end of the first lever may be coupled to the mounting plate and an opposing second end of the first lever may be able to move in a linear direction. A bracket may be coupled to the second side of the first side panel and be disposed above the brake assembly and over a portion of the first lever. The bracket may include a hole through which a cable may pass and be attached to the first lever.

The movable barrier operator release mechanism may further include a second shaft disposed above the first shaft extending through the first side panel. A chain wheel may be disposed around the second shaft and be operable to rotate the second shaft. A second lever may be disposed around the second shaft. The second lever may translate rotational movement into linear movement. The second lever may have a first length in a first direction and a second length in a second direction where the first direction is perpendicular to the second direction. The first length may be greater than the second length.

The present disclosure is further directed to a movable barrier operator release mechanism including a chassis that has a first panel and an opposing second panel. The first panel has a first face and an opposing second face. The movable barrier operator release mechanism further includes a motor mounted between the first face of the first panel and the second panel. The motor includes first shaft that extends through the first panel. A brake assembly is mounted to the second face. The first shaft extends into the brake assembly. A first lever, with a first end and an opposing second end, is coupled to the brake assembly. The first lever pivots about the first end to disengage the brake assembly. The movable barrier operator release mechanism may include a cable attached to second end of the first lever to move the first lever. A bracket may be coupled to the second face of the first panel and disposed over the second end of the first lever. The bracket may include a hole through which the cable may extend, providing leverage for moving the first lever.

The movable barrier operator release mechanism may further include a second lever disposed above the first lever. The second lever may move the first lever when the rotated. A second shaft extending through the first panel may be disposed above the first shaft. The second shaft may extend through an opening in the second lever. The second lever may move away from the first panel when it is rotated. The second lever may disengage the brake assembly when it moves away from the first panel. A chain wheel may be disposed around the second shaft. The second lever may couple the rotation of the chain wheel to the rotation of the second shaft when it moves away from the first panel. A spring may be disposed around the second shaft and between the chain wheel and the second lever to disengage the rotation of the chain wheel from the second shaft.

The present disclosure is further directed to a movable barrier operator release mechanism that includes a chassis having a first panel and a first shaft extending away from the first panel. The movable barrier operator release mechanism further includes a second shaft disposed over the first shaft and extending in the first direction away from the first panel. A brake assembly is coupled to the first panel with the first shaft extending into the brake assembly. The brake assembly includes a first lever pivotally operable to disengage the brake assembly when moved in the first direction. A second lever is disposed around the second shaft. The second lever translates rotational movement into linear movement and moves the first lever in the first direction. The movable barrier operator release mechanism may further include a chain wheel having a first and second side that is disposed adjacent to the second lever with the second lever disposed between the first side of the chain wheel and the first side panel. A spring may be disposed between the second lever and the chain wheel. A first pin may be disposed transversely through the shaft perpendicular to the axial direction and adjacent the second side of the chain wheel. The second shaft may extend through the chain wheel and the spring. The chain wheel may include a second pin disposed on the second side of the chain wheel that engages the first pin to couple the rotation of the chain wheel to the second shaft. There may be a structure having sloped side walls coupled to the first panel. The second lever may have a first length in a second direction and a second length in a third direction where the second direction is perpendicular to the third direction and the second direction is perpendicular to the first direction. The first length may be greater than the second length.

What is claimed is:

1. A movable barrier operator release mechanism, comprising:

a first side panel having a first side and an opposing second side;

a motor disposed at the first side of the first side panel, the motor comprising a first shaft;

a brake assembly disposed at the second side of the first side panel;

the first shaft extending through the first side panel and into the brake assembly;

a first lever disposed between the brake assembly and the first side panel; and a bracket disposed over a portion of the first lever and coupled only to the first side panel, wherein the first lever is operable to disengage the brake assembly.

2. The movable barrier operator release mechanism of claim 1, further comprising:

a hole disposed in the bracket; and a cable disposed through the hole and attached to the portion of the first lever, wherein the bracket is disposed over the brake assembly.

3. The movable barrier operator release mechanism of claim 1, wherein the brake assembly is structurally arranged to stop the rotation of the first shaft when engaged.

4. The movable barrier operator release mechanism of claim 1, wherein the brake assembly includes a mounting plate, wherein a first end of the first lever is coupled to the mounting plate, and wherein a second opposing end of the first lever is able to move in a linear direction.

5. The movable barrier operator release mechanism of claim 1, further comprising:

a second shaft disposed above the first shaft, the second shaft extending through the first side panel; and a chain wheel disposed around the second shaft operable to rotate the second shaft.

6. A movable barrier operator release mechanism, comprising:

a first side panel having a first side and an opposing second side;

a motor disposed at the first side of the first side panel, the motor comprising a first shaft;

a brake assembly disposed at the second side of the first side panel;

the first shaft extending through the first side panel and into the brake assembly;

a first lever disposed between the brake assembly and the first side panel, wherein the first lever is operable to disengage the brake assembly;

a second shaft disposed above the first shaft, the second shaft extending through the first side panel;

a chain wheel disposed around the second shaft operable to rotate the second shaft; and a second lever disposed around the second shaft, the second lever operable to translate rotational movement into linear movement, wherein the second lever is able to move the first lever.

7. The movable barrier operator release mechanism of claim 6, wherein the second lever has a first length in a first direction and a second length in a second direction, wherein the second direction is perpendicular to the first direction and wherein the first length is greater than the second length.

8. A movable barrier operator release mechanism, comprising:

a chassis including a first panel and an opposing second panel, wherein the first panel has a first face and an opposing second face;

a motor mounted between the first face of the first panel and the second panel, wherein the motor includes a first shaft extending through the first panel;

a brake assembly mounted to the second face, wherein the first shaft extends into the brake assembly;

a first lever having a first end and an opposing second end, wherein the first end is coupled to the brake assembly; and a bracket disposed over the second end of the first lever, and wherein the first lever pivots about the first end to move the second end of the first lever toward the bracket to disengage the brake assembly.

9. The movable barrier operator release mechanism of claim 8, further comprising:

a cable operable to move the first lever, wherein the cable is attached to the second end of the first lever.

10. The movable barrier operator release mechanism of claim 9, further comprising:

a bracket coupled to the second face of the first panel; and a hole disposed in the bracket, wherein the cable is disposed through the hole to thereby provide leverage for moving the first lever.

11. A movable barrier operator release mechanism, comprising:

a chassis including a first panel and an opposing second panel, wherein the first panel has a first face and an opposing second face;

a motor mounted between the first face of the first panel and the second panel, wherein the motor includes a first shaft extending through the first panel;

a brake assembly mounted to the second face, wherein the first shaft extends into the brake assembly;

a first lever having a first end and an opposing second end, wherein the first end is coupled to the brake assembly, wherein the first lever pivots about the first end to disengage the brake assembly; and a second lever disposed above the first lever, wherein the second lever moves the first lever when rotated.

12. A movable barrier operator release mechanism, comprising:

a chassis including a first panel and an opposing second panel, wherein the first panel has a first face and an opposing second face;

a motor mounted between the first face of the first panel and the second panel, wherein the motor includes a first shaft extending through the first panel;

a brake assembly mounted to the second face, wherein the first shaft extends into the brake assembly; and a first lever having a first end and an opposing second end, wherein the first end is coupled to the brake assembly, wherein the first lever pivots about the first end to disengage the brake assembly;

a second shaft disposed above the first shaft, the second shaft extending through the first panel; and a second lever including an opening, wherein the second shaft extends through the opening, wherein the second lever moves away from the first panel when rotated, and wherein the second lever disengages the brake assembly when moving away from the first panel.

13. The movable barrier operator release mechanism of claim 12, further comprising:

a chain wheel disposed around the second shaft, wherein the second lever couples a rotation of the chain wheel to the second shaft when moved away from the first panel.

14. The movable barrier operator release mechanism of claim 13, further comprising:

a spring disposed adjacent the chain wheel and around the second shaft, the spring operable to disengage the rotation of the chain wheel from the second shaft.

15. A movable barrier operator release mechanism, comprising:

a chassis including a first panel;

a first shaft extending in a first direction away from the first panel;

a second shaft extending in the first direction away from the first panel, wherein the second shaft is disposed above the first shaft;

a brake assembly coupled to the first panel, wherein the brake assembly includes a first lever pivotally operable to disengage the brake assembly when moved in the first direction, wherein the first shaft extends into the brake assembly; and a second lever disposed around the second shaft, wherein the second lever translates rotational movement into linear movement in the first direction, wherein the second lever is operable to move first lever in the first direction.

16. The movable barrier operator release mechanism of claim 15, further comprising:

a chain wheel having a first side and a second opposing side, the chain wheel disposed adjacent the second lever, wherein the second lever is disposed between the first panel and first side of the chain wheel, wherein the second shaft extends through the chain wheel;

a spring having a first end and an opposing second end, the first end of the spring disposed adjacent the second side of the chain wheel; and a first pin disposed adjacent the second end of the spring, the first pin being disposed transversely through the second shaft perpendicular to an axial direction of the second shaft.

17. The movable barrier operator release mechanism of claim 16, wherein the chain wheel includes a second pin disposed on the second side of the chain wheel, wherein the second pin engages the first pin to couple the rotational movement of the chain wheel to the second shaft.

18. The movable barrier operator release mechanism of claim 15, further comprising:

a structure coupled to the first panel, wherein the structure has slope side walls.

19. The movable barrier operator release mechanism of claim 15, further comprising:

an opening disposed in a first end of the second lever for attaching a cable.

20. The movable barrier operator release mechanism of claim 15, wherein the second lever has a first length in a second direction and a second length in a third direction, wherein the second direction is perpendicular to the first direction and the second direction is perpendicular to the third direction, wherein the first length is greater than the second length.

* * * * *